US008533001B2

(12) United States Patent
Skiba

(10) Patent No.: US 8,533,001 B2
(45) Date of Patent: Sep. 10, 2013

(54) SYSTEM AND METHOD FOR COMPUTING ATHLETIC PERFORMANCE

(75) Inventor: Philip Skiba, Clark, NJ (US)

(73) Assignee: PhysFarm Training Systems, LLC, Neptune, NJ (US)

( * ) Notice: Subject to any disclaimer, the term of this patent is extended or adjusted under 35 U.S.C. 154(b) by 999 days.

(21) Appl. No.: 12/079,949

(22) Filed: Mar. 27, 2008

(65) Prior Publication Data

US 2008/0261776 A1 Oct. 23, 2008

Related U.S. Application Data

(60) Provisional application No. 60/920,646, filed on Mar. 28, 2007.

(51) Int. Cl.
*G06Q 10/00* (2012.01)

(52) U.S. Cl.
USPC ..... 705/1.1; 482/8

(58) Field of Classification Search
USPC ..... 705/1.1
See application file for complete search history.

(56) References Cited

U.S. PATENT DOCUMENTS

| | | | | |
|---|---|---|---|---|
| 3,846,704 | A * | 11/1974 | Bessette | 340/870.28 |
| 5,663,897 | A * | 9/1997 | Geiser | 702/182 |
| 5,864,518 | A * | 1/1999 | Geiser | 368/10 |
| 6,450,922 | B1 * | 9/2002 | Henderson et al. | 482/8 |
| 7,254,516 | B2 * | 8/2007 | Case et al. | 702/182 |
| 7,480,512 | B2 * | 1/2009 | Graham et al. | 455/456.3 |
| 7,603,255 | B2 * | 10/2009 | Case et al. | 702/182 |
| 2006/0229163 | A1 * | 10/2006 | Waters | 482/8 |
| 2007/0033069 | A1 * | 2/2007 | Rao et al. | 705/2 |
| 2007/0082789 | A1 * | 4/2007 | Nissila et al. | 482/8 |
| 2007/0219059 | A1 * | 9/2007 | Schwartz et al. | 482/8 |
| 2007/0232455 | A1 * | 10/2007 | Hanoun | 482/8 |
| 2008/0103794 | A1 * | 5/2008 | Pettiross et al. | 705/1 |
| 2008/0261776 | A1 * | 10/2008 | Skiba | 482/8 |
| 2009/0098980 | A1 * | 4/2009 | Waters | 482/8 |

OTHER PUBLICATIONS

Physfarm A-K.*
Midweek A-C.*
CPS A-I.*
P. Skiba, DO, MS, "Calculation of Power Output and Quantification of Training Stress in Distance Runners: The Development of the GOVSS Algorithm," Revised Sep. 16, 2006.
T. Busso, et al., "Effects of Training Frequency on the Dynamics of Performance Response to a Single Training Bout," Journal of Applied Physiology 92:572-580, 2002.
R.H. Morton, et al., "Modeling Human Performance in Running," Modeling Methodology Forum, American Physiological Society, 1990.

(Continued)

*Primary Examiner* — Matthew L. Brooks
(74) *Attorney, Agent, or Firm* — Lerner, David, Littenberg, Krumholz & Mentlik, LLP

(57) ABSTRACT

A system and method of calculating athlete performance, may include receiving information relating to at least one date of performance of physical activity and generating a proposed training schedule, including one or more training sessions, corresponding to the at least one date of performance of physical activity. Further, the system and method may include receiving information relating to records of the athlete's prior performances, and determining a performance model including predicted athlete performance based on the calculated training schedule and the prior performances.

6 Claims, 11 Drawing Sheets

(56) References Cited

OTHER PUBLICATIONS

E.W. Bannister, et al., "Planning for Future Performance: Implications for Long Term Training," Canadian Journal of Applied Sport Sciences, vol. 5, Issue 3, pp. 170-176, 1980.
T. Busso, et al., "Modeling of Adaptations to Physical Training by Using a Recursive Least Squares Algorithm," Journal of Applied Physiology 82: 1685-1693, 1997.
E.W. Bannister, et al., "Training Theory and Taper: Validation in Triathlon Athletes," European Journal of Applied Physiology and Occupational Physiology, 79(2): 182-91, Jan. 1999.
G.P. Millet, et al., "Modelling the Transfers of Training Effects on Perfomance in Elite Triathletes," International Journal of Sports Medicine, 23(1): 55-63, Jan. 2002.
J.R. Fitz-Clarke, et al., "Optimizing Athletic Performance by Influence Curves," Journal of Applied Physiology and Occupational Physiology, 71(3): 1151-8, Sep. 1991.
R.H. Morton, "Modelling Training and Overtraining," Journal of Sports Sciences, 15: 335-340, 1997.
P. Hellard, et al., "Assessing the Limitations of the Baniser Model in Monitoring Training," Journal of Sports Sciences, 24(5): 509-520, May 2006.
E.W. Bannister, et al., "Dose/Response Effects of Exercise Modeled from Training: Physical and Biochemical Measures," Annals of Physiological Anthropology, 11(3):345-356, May 1992.
E.W. Bannister, et al., "Variations in Iron Status with Fatigue Modelled form Training in Female Distance Runners," European Journal of Applied Physiology and Occupational Physiology, 54: 16-23, 1985.
T. Taha, et al., "Systems Modelling of the Relationship Between Training and Performance," Sports Medicine, 33(14): 1061-1073, 2003.
T. Busso, et al., "A Systems Model of Training Responses and its Relationship to Hormonal Responses in Elite Weight-Lifters," European Journal of Applied Physiology and Occupational Physiology, 61: 48-54, 1990.
T. Busso, et al., "Hormonal Adaptations and Modelled Responses in Elite Weightlifters During 6 Weeks of Training," European Journal of Applied Physiology and Occupational Physiology, 64:(4) 381-6, 1992.
T. Busso, et al., "Fatigue and Fitness Modelled From the Effects of Training on Performance," European Journal of Applied Physiology and Occupational Physiology, 69(1) 50-4, 1994.

* cited by examiner

FIG. 3C

350

KD.P (2007)

Sport: Cycling

Start Date: 3/15/07

$R^2$: 0.7551

| Date | Training | Test | |
|---|---|---|---|
| 3/15/07 | 0.00 | | T |
| 3/16/07 | 12.79 | | T |
| 3/17/07 | 0.00 | | T |
| 3/18/07 | 15.90 | | T |
| 3/19/07 | 9.24 | | T |
| 3/20/07 | 12.90 | | T |
| 3/21/07 | 15.27 | | T |
| 3/22/07 | 56.95 | | T |
| 3/23/07 | 0.00 | | T |
| 3/24/07 | 87.74 | 404.00 | T |
| 3/25/07 | 0.00 | | T |
| 3/26/07 | 33.75 | | T |
| 3/27/07 | 85.48 | 384.00 | T |
| 3/28/07 | 86.97 | 382.00 | T |
| 3/29/07 | 0.00 | | T |
| 3/30/07 | 0.00 | | T |
| 3/31/07 | 94.58 | 407.00 | T |
| 4/1/07 | 0.00 | | T |
| 4/2/07 | 0.00 | | T |
| 4/3/07 | 100.29 | 445.00 | T |
| 4/4/07 | 0.00 | | T |
| 4/5/07 | 0.00 | | T |
| 4/6/07 | 40.54 | | T |
| 4/7/07 | 85.12 | | T |
| 4/8/07 | 78.59 | | T |
| 4/9/07 | 0.00 | | T |
| 4/10/07 | 54.89 | | T |
| 4/11/07 | 49.45 | | T |
| 4/12/07 | 0.00 | | T |
| 4/13/07 | 0.00 | | T |
| 4/14/07 | 0.00 | | T |
| 4/15/07 | 0.00 | | T |

☑ Show forecast + -

SYSTEM AND METHOD FOR COMPUTING ATHLETIC PERFORMANCE

CROSS-REFERENCE TO RELATED APPLICATIONS

This application claims the benefit of the filing date of United States Provisional Patent Application No. 60/920,646 filed Mar.28, 2007, the disclosure of which is hereby incorporated herein by reference.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Computer Program Listing Appendices A and B including code relating to the present invention are submitted herewith and hereby incorporated by reference. The computer program listing appendices are included as two files on a compact disc, the files being named "Performance Model.rbbas.txt" (21 KB) and "Solver.rbbas.txt" (4 KB). The submitted disc, including the stored files in American Standard Code for Information Interchange (ASCII) format, was created on Mar. 27, 2008.

BACKGROUND OF THE INVENTION

Athletes respond to training stimulus with an increase in performance. In 1975, Banister's Training Impulse Score (TRIMPS) evolved into a system relating training volume and intensity according to the algorithm:

TRIMPS=(Exercise duration)×(Average heart rate)×(Heart rate dependent, intensity based weighting factor)

This intensity-based weighting factor is exponential in nature, and was derived by analyzing the plasma lactate response curves of athletes to a standardized exercise protocol. In this system, heavier exercise (as evidenced by a higher average heart rate) is more heavily weighted than easier exercise to account for the different metabolic and exertional requirements of each.

This system was found to be valuable not only as a measurement of training, but as a means to predict future athletic performance utilizing the relationship: Performance=Fitness−Fatigue, where fitness and fatigue may be positive and negative effects of training.

After a bout of training, an athlete becomes both more fit and more tired. Initially, the fatigue gain is greater than the fitness gain. In the days immediately following heavy training, this leads to a decrease in performance. However, fatigue also dissipates more quickly than fitness does. Therefore, after enough rest has been taken, the new level of fitness is unmasked, and this is evidenced by improved performance. This may be expressed mathematically as:

$$P(t)=k_1g(t)^{-t/\tau 1}-k_2h(t)^{-t/\tau 2}$$

In this equation, p(t), g(t) and h(t) denote performance, fitness and fatigue at any time t, respectively. $k_1$ and $k_2$ ($k_2>k_1$) are multiplying constants with no direct physiologic correlation other than those athletes with relatively large $k_2$ values take longer to recover from training. The fact that $k_2$ is larger than $k_1$ is indicative of the observation that fatigue resulting from a training bout initially masks fitness improvements gained from that bout, as seen above. As was previously intimated, both fitness and fatigue have exponential decay constants ($\tau_1$ and $\tau_2$, $\tau_1>\tau_2$), such that fitness persists longer than fatigue.

Performance can be considered to be the sum of the positive and negative influences of all previously undertaken training episodes, each of which is decaying exponentially. This relationship can be described by the convolution integral:

$$\text{Performance}=\int_0^t (k_1\cdot e^{-(t-u)/\tau 1}-k_2\cdot e^{-(t-u)/\tau 2})\cdot w(u)\cdot du$$

Where (t−u) is equal to the time between training doses and w(u) is the training dose in arbitrary units (i.e. TRIMPS, Training Stress Score (TSS) or any other training measurement that takes into account both the intensity and duration of the exercise undertaken).

Currently desired is a way for a performance curve to indicate how an athlete will perform on any given day. This is problematic because all of the input data is in arbitrary units. While these units are indicative of both the intensity and duration of exercise undertaken, the number has only indirect real-world correlation. Therefore, the difference between intensity and duration of exercise is not easily expressed as a real-world correlation. Accordingly, a system and method for predicting real-world performance (e.g., athlete power output as measured by laboratory or on-bike equipment for standardized exercise task, distance a ball is thrown, velocity for a standard run or swim) is desired.

SUMMARY OF THE INVENTION

One aspect of the present invention provides a method of calculating athlete performance, comprising receiving information relating to an athlete's goal performance, receiving information relating to a proposed training schedule, including one or more training sessions, to prepare for the goal performance, receiving information relating to records of the athlete's prior performances, and determining a performance model including predicted athlete performance based on the calculated training schedule and the prior performances.

Another aspect of the invention provides a method of determining athlete performance, comprising receiving information relating to a performance goal for physical activity and determining a proposed training schedule relating to the performance goal, wherein the proposed training schedule may include a series of workouts to be performed by the athlete. This method may further comprise determining predicted results of training, including predicted results of the goal performance. Information relating to the athlete's test performance may also be received and compared to the predicted results of training. Based on this comparison, at least one of the training schedule and the performance goal may be revised.

A further aspect of the present invention comprises a method of computing athlete performance, comprising receiving at a processor data relating to an athlete's goal performance and data relating to training for the goal performance, including at least one of future training and past training. A predicted result of the goal performance may be determined based on the data relating to training, and this predicted result may be output to a user.

Yet another aspect of the present invention provides a system for predicting athlete performance, comprising an interface for inputting information relating to a training schedule and recorded training data, a database for storing the information relative to a training schedule, training data, and a processor for computing information related to a predicted athlete performance based on the information relative to a training schedule and recorded training data.

BRIEF DESCRIPTION OF THE DRAWINGS

FIGS. 3A-3D are screenshots relating to data entry according to an aspect of the present invention.

DETAILED DESCRIPTION

Figure 1:
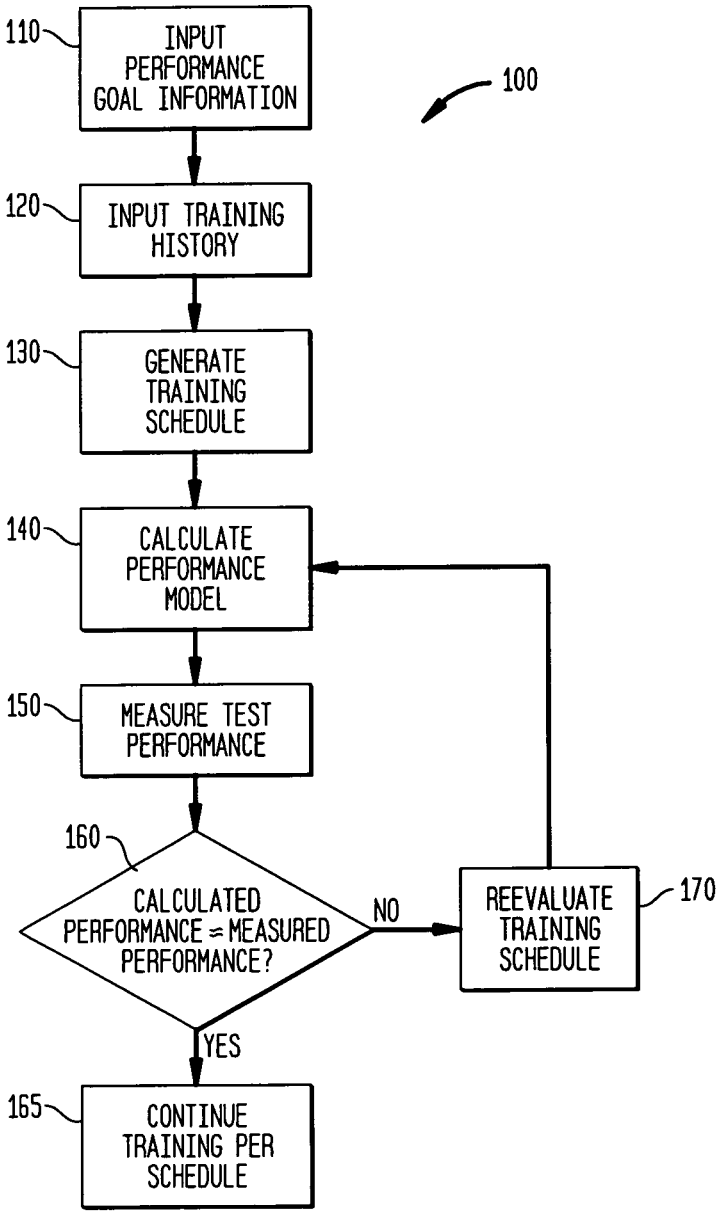
FIG. 1 is a flowchart illustrating a method of calculating athlete performance according to an aspect of the present invention.

FIG. 1 illustrates a method 100 for calculating athlete performance. It should be understood that the steps of the method 100 may be performed in any order, and that various other steps, although not shown in FIG. 1, may be included. Further, some steps of the method may be modified without departing from the meaning of the method 100. Additionally, various steps of the method 100 may be executed on a computing device, such as that described in the system 200 below.

In this method, performance goal information is input to the computing device (step 110) and optionally training history information is also entered (step 120). A training schedule for the athlete is generated (130). As part of this training schedule, a training stress associated with sessions in the training schedule may be calculated. Further, a performance model may be calculated based on the training stress (step 140). Test performance may be measured (step 150) and input to the computing device, where is it is compared with the calculated performance (step 160). If the measured and calculated performances are within a predefined range of one another, the athlete may continue training according to the training schedule (step 165). However, if the calculated and measured stresses are not closely matched, the training schedule may be revised or the model re-calculated to generate a model that more closely represents the athlete's response to training (step 170), whereupon the process would return to step 130 to recalculate the performance model.

In step 110, a user may input performance goal information. Such performance goal information may include information relating to the athlete, the physical activity to be performed by the athlete, the dates of performance of physical activity, the current physical capabilities of the athlete, goal physical capabilities of the athlete, or any combination of these. Further information may also be input as desired by the user.

The information relating to the athlete may be any type of identification data, such as the athlete's name or team name. Alternatively or additionally, the information may relate more closely to the athlete's physical capabilities. For example, the information may include age or sex.

The physical activity to be performed by the athlete may be any athletic situation where the athlete exhibits a response to training stimulus. For example, the physical activity may be a sport such as tennis, or part of a sport, such as running, pitching, etc. Further, the activity may be a factor, such as reaction time (critical to a NASCAR driver).

The dates of performance of physical activity may be one or more select dates, a range of dates, or several ranges of dates relating to different events. For example, the user may input a training start date and a competition date. According to one aspect, the system may recognize from this data that one or more dates between the training start date and the competition date are training dates.

The physical capabilities of the athlete may include information such as current capabilities and/or goal capabilities. For example, a runner may input that he is capable of running a six-minute mile. Alternatively or additionally, the athlete may input that he is aiming to run a five and a half minute mile and then determine (or allow the computing device to determine) a reasonable training program to achieve that goal.

According to one aspect, the user may input training history data in step 120. Such training history data may include measurements of prior performances. For example, the training history may relate to an amount of physical energy exerted by the athlete during the prior performance, a description of the prior performance, and details relating to intensity and duration of the prior performance.

The training history may be factored into generation of training schedules and calculations of performance models. For example, the athlete's approximate fitness level may be determined from the training history, and thus an appropriate training schedule may be generated based on that fitness level. Similarly, the athlete's prior performances may indicate how the athlete recovers from strenuous activity. Such an indication, as well as the indication of fitness level, may be used to calculate how the athlete will perform on future dates if the training schedule is followed. One aspect of the invention enables the user to select appropriate initial model constants according to the athlete's personal history, if formal performance data is not available. For example, a user may consult a lookup table including prior performance data of another athlete with similar physical ability. According to another aspect, a processor may select the initial model constants.

Step 130 involves generating a training schedule. The training schedule may include training sessions and tests to be performed over the training period. The training sessions may be workouts structured in varying intensities and durations. For example, the runner training to run a five and a half minute mile may have a training schedule including running three six and a half minute miles one day, jogging five miles another day, and sprinting twelve 200 meter stretches another day. The tests may be the training session workouts or separate events. For example, the athlete may measure his performance during a workout, as described in further detail below with respect to step 150. Alternatively, the test may be attempting the activity to be performed on competition day. Thus, for example, the runner would attempt to run a five and a half minute mile. According to yet another alternative, the test may be an abbreviated version of the activity to be performed on competition day. So, for example, if the goal activity is running a marathon, the athlete may test his performance during two minutes of running.

According to one aspect, the training schedule may be generated by the user. Thus the user may devise a schedule with a series of structured training sessions and enter such schedule as input to the system. According to another aspect, the training schedule may be generated by the computing device. Thus, for example, the computing device may select a number of days between the training start date and the competition date and enter specified training sessions for those days. The computer generated training schedule may be more effective if increased data is entered. For example, a more effective training schedule may be generated if the user inputs the athlete's sport and a goal performance on the competition date, as opposed to merely inputting the competition date.

According to one aspect, generation of a training schedule in step 130 may include calculating training stress associated with the schedule. Training stress is a quantifier of the athlete's physical exertion during training, and may account for the duration and intensity of the physical training. For example, training stress may be expressed by the equation:

Training Stress=Duration*Intensity*Weighting factor

Duration is the time spent exercising. Intensity is how hard the athlete exercised for that period. The weighting factor accounts for the fact that exercise becomes more difficult as speed is increased, and this increase is nonlinear. For example, running five miles in thirty minutes, as opposed to sixty minutes, is not twice as difficult but many times more difficult.

Initially the training stress calculation may include some approximations. For example, if no training history data has been entered, the intensity factor may vary. Accordingly, an estimated intensity, based on speed or another factor, may be used to calculate the training stress. However, such estimated intensity may not always match the actual intensity of the workout for the athlete, because athletes vary in strength, speed, fitness, etc. Thus, what may be considered a very intense workout for one athlete may be more relaxed to another. If the user desires, the system calculates an exact intensity factor after each workout by analyzing data files, which improves data quality.

According to one aspect, the training stress may be calculated for each training session in the training schedule. According to an alternative embodiment, training stress may be calculated only for particular sessions in the training schedule, or for the training schedule as a whole. Thus, for example, stresses may be calculated only for the most intense workouts as those are most likely to affect athlete conditioning during early stages of training.

In step 140 a performance model may be generated based on the training stress and one or more constants. According to one embodiment, four separate constants may be used: positive impulse, negative impulse, positive time, and negative time. The positive and negative impulse constants relate to positive and negative training effects with each workout. So, for example, the positive training effect may be increased fitness, whereas the negative training effect may be increased fatigue. The positive and negative time constants may relate to a time required for the positive and negative training effects to dissipate, respectively.

As an example:

| | |
|---|---|
| Positive impulse: | 1 |
| Negative impulse: | 5 |
| Positive time: | 16 |
| Negative time: | 3 |

Thus, these settings for the constants indicate that for the athlete training causes a fivefold increase in fatigue for every increase in fitness. However, the fitness (positive effect) will last for sixteen days, whereas the fatigue (negative effect) will dissipate much more quickly (three days).

According to another aspect, the calculations may account for variables other than the athlete's levels of fitness or fatigue. For example, the athlete's nutrition and sleep habits may alter the response to training, and the user would observe this as unexpected deviations of measured performances from predicted performances. This information could be input to the system and factored into the calculations to improve future predictions.

The positive and negative training effect constants may be used in the following equation:

$$\text{Positive training effect} = \int_0^t (k_1 \cdot w(u) \cdot e^{-(t-u)/\tau 1})$$

$$\text{Negative training effect} = \int_0^t (k_2 \cdot w(u) \cdot e^{-(t-u)/\tau 2})$$

where $\tau_1$ and $\tau_2$ are exponential decay constants, where (t−u) is equal to the time between training doses, and w(u) is the training stress in arbitrary units.

To obtain a performance value for one or more days, a matrix may be generated, with separate columns for fitness and fatigue populated on a daily basis. The difference between the columns for each day may be that day's performance value.

This arbitrary performance prediction is transformed into a percentile scale. For this step it may be assumed that the minimum test performance is equal to the minimum predicted performance value and the maximum test performance value is equal to the maximum predicted performance value.

$$PPP=((PP+((|\text{Min}PP|)+(\text{SCALEFACTOR})/(|\text{Min}PP\uparrow+(\text{SCALEFACTOR})+(\text{Max}PP)))$$

Where:

PPP=Predicted Performance Percentile

PP=Predicted Performance

|MinPP|=Absolute value of the minimum predicted performance

SCALEFACTOR=a numerical quantity that is iteratively varied in order to improve the fit between model predictions and real-world test values MaxPP=Maximum predicted performance The test performance data is expressed as a percentage of maximum measured test performance.

TP/MaxTP=TPP

Where:

TPP=Test Performance Percentile

The PPP and TPP values are then compared through a 2 step process. In the first step, the model constants $k_1$, $k_2$, $\tau_1$ and $\tau_2$ are adjusted until the sum of the squares of the differences between the predicted performance percentile value and test percentile data are minimized and the best fit obtained. In the second step, the SCALEFACTOR is iteratively varied until a final, lowest possible sum of squares is achieved.

Because athletes typically test and train on the same day, a problem of how finely to iteratively evaluate the equation may be encountered. To simplify the situation, it may be assumed that the test performance on any day t should be approximately equal to the predicted performance at midnight on the day before, i.e. day t−1.

The percentiles are then converted to real world values for the athlete and coach to review by multiplying both the predicted and actual percentile values by the maximum measured test performance.

Although the absolute values of k1 and k2 are in part dependant on the scaling method used and the sport, the ratio of the two remains relatively constant between sports, i.e. 1:2, 1:4 etc.

According to one aspect of the present invention, multiple constant values may be tested to determine the best prediction of training stress to performance. These predictions may be periodically double-checked against actual values, and adjusted accordingly.

According to another aspect, the constants initially used in the step of calculating performance may be approximations based on prior data from other athletes. A statistical analysis, such as comparing the sum of the squares, of an athlete's tested performance and predicted performance may be used to determine whether and how constants are changed. Any number of optimization techniques, such as the brute force method, the "hill climb" method, or other solving algorithms such as simplex, levenberg-marquardt, etc. may be used to determine the constants. The brute force method may be preferable where combinations of all possible/physiologically plausible combinations of constants are tested, because other optimization techniques may result in the algorithm narrowing in on a "local" best fit, rather than the "global" best fit for the equations. The brute force method ensures that the peculiarities of different optimizations algorithms are removed from the process.

In step 150, test performance may be measured. The measurements may be taken using a meter, such as a power meter, a heart rate meter, a stop watch, or the like. According to one aspect, the meter may also determine a quantitative value for the training stress exerted in the test performance. However, according to another aspect, the measurements from the meter may be input to the computing device 210 with other indicia to calculate the training stress. Examples of such measurements and calculations are described in further detail below with respect to FIGS. 4A-4B.

The measured test performance may be entered as input and compared with the calculated performance in step 160. If the measured and calculated performance values are accurately matched (e.g., differ only within a predefined range of values), the training schedule and performance model may remain unchanged. Thus, the athlete may continue training according to the schedule (step 165). Even in this instance, however, it may be beneficial for the athlete to continue to measure test performance periodically to ensure that the accuracy of the performance model is maintained.

If the measured test performance and calculated performance are not within a predefined range of one another, the training schedule may be reevaluated (step 170). Alternatively or additionally, revised calculations may be performed. For example, the constants may be varied and a new or revised performance model may be generated.

According to one aspect, the user may make one or more modifications to the training schedule as deemed necessary to achieve the goal performance. For example, if an athlete fails to complete the training session for a particular day, this may affect the goal performance depending on the proximity of the competition date. Alternatively, the competition date may be changed for any number of reasons, and thus a revised training schedule generated.

According to another aspect, the performance model calculations in step 140 may assume no initial performance ability. However, according to another aspect, an initial performance factor may be considered: This factor is a static additive term, whereas performance capacity, in contrast, is always changing.

According to one aspect, an initial performance capacity that decays exponentially according to the positive training effect constants may be inserted. In other words, the initial performance capacity disappears as the new performance capacity builds with training. This makes the initial days of predicted performance more accurate. Accordingly:

Initial performance factor:

$$\int_0^{\tau} (k1 \cdot InitPerf \cdot e - (t-u)/\tau 1)$$

Where:

InitPerf=Initial Performance Ability

This factor may or may not be used, depending upon the preference of the user and/or how much historical training data is available for analysis.

Figure 2:
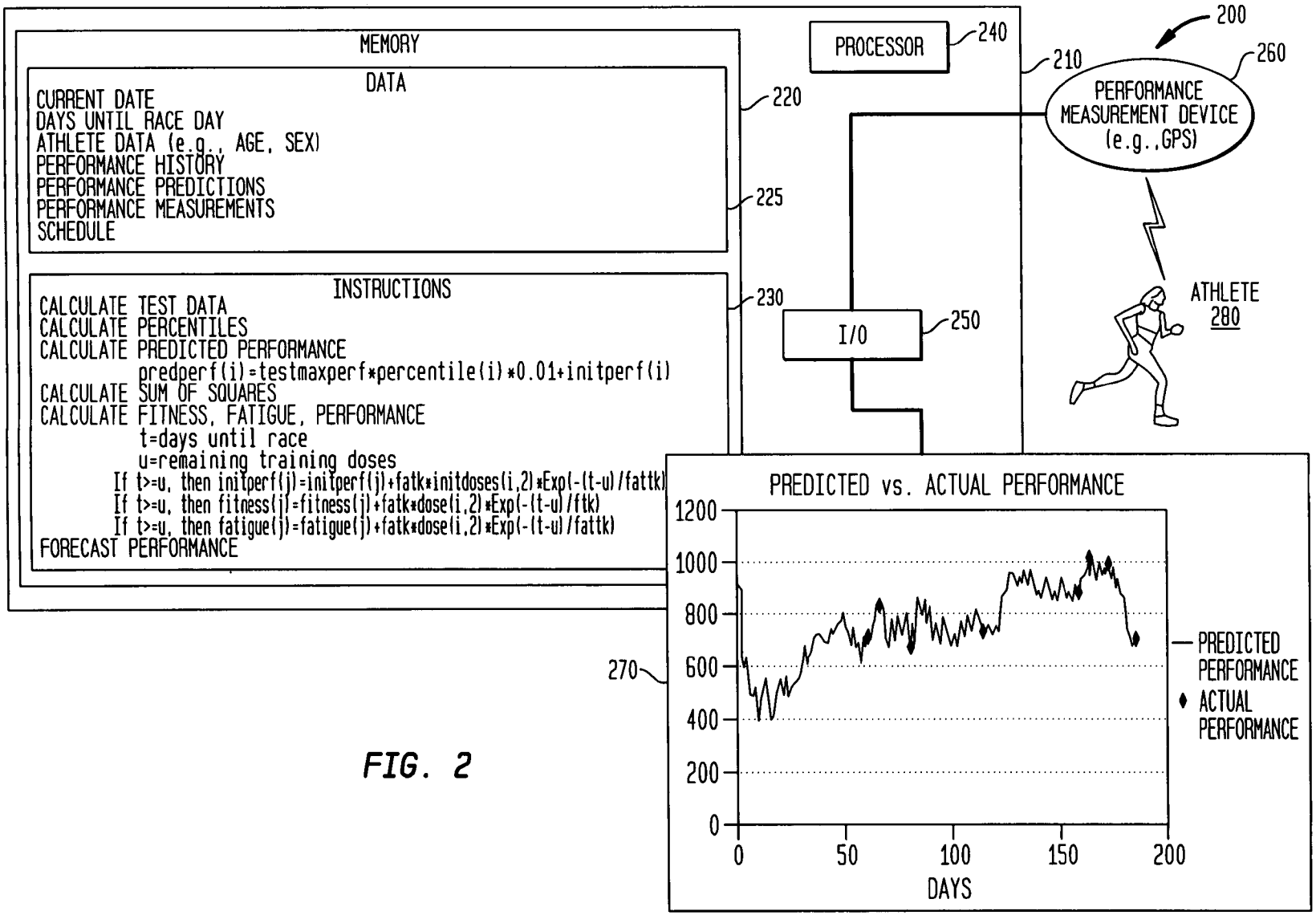
FIG. 2 is a system diagram according to an aspect of the present invention.

As shown in FIG. 2, a system 200 in accordance with one aspect of the invention comprises a user input 260 and a display device 270 connected to a computing device 210. The computing device 210 contains a processor 240, memory 220, an input/output ("I/O") port 250, and other components typically present in general purpose computers.

Memory 220 stores information accessible by processor 240 including instructions 230 for execution by the processor 240 and data 225 which is retrieved, manipulated or stored by the processor 240. The memory 220 may be of any type capable of storing information accessible by the processor, such as a hard-drive, ROM, RAM, CD-ROM, write-capable, read-only, or the like.

The instructions 230 may comprise any set of instructions to be executed directly (such as machine code) or indirectly (such as scripts) by the processor 240. In that regard, the terms "instructions," "steps" and "programs" may be used interchangeably herein.

Data 225 may be retrieved, stored or modified by processor 240 in accordance with the instructions 230. The data 225 may be stored as a collection of data. For instance, although the invention is not limited by any particular data structure, the data 225 may be stored in computer registers, in a relational database as a table having a plurality of different fields and records, as an XML. The data 225 may also be formatted in any computer readable format such as, but not limited to, binary values, ASCII or EBCDIC (Extended Binary-Coded Decimal Interchange Code). Moreover, any information sufficient to identify the relevant data may be stored, such as descriptive text, proprietary codes, pointers, or information which is used by a function to calculate the relevant data.

The computing device 210 may comprise any device capable of processing instructions and transmitting data to and from humans, including wireless phones, personal digital assistants, palm computers, laptop computers, some mp3 players, etc.

Further, although the processor 240 and memory 220 are functionally illustrated in FIG. 2 within the same block, it will be understood by those of ordinary skill in the art that the processor 240 and memory 220 may actually comprise multiple processors and memories that may or may not be stored within the same physical housing. For example, some or all of the instructions 230 and data 225 may be stored on removable CD-ROM and others within a read-only computer chip. Some or all of the instructions 230 and data 225 may be stored in a location physically remote from, yet still accessible by, the processor 240. Similarly, the processor 240 may actually comprise a collection of processors which may or may not operate in parallel.

The input/output port 250 may include any type of data port, such as a universal serial bus (USB) drive, CD/DVD drive, zip drive, SD/MMC card reader, etc. Further, the input/output port may be compatible with any type of user interface, such as a keyboard, mouse, game pad, touch-sensitive screen, microphone, etc.

The display 270 may be any type of device capable of communicating data to a user. For example, the display 270 may be a liquid-crystal display (LCD) screen, a plasma screen, etc. The display 270 may provide various types of information to the user, such as predicted performance models, training schedules, and any other type of output data.

According to one aspect, the display 270 and/or the input/output port 250 may provide a graphical user interface (GUI) for the user to enter and receive information. For example, the display 270 may depict a series of prompts requesting information from the user. In response to these prompts, the user may enter data by, for example, selecting an item from a drop-down menu, entering information in predefined data fields, or linking information from a separate application or device.

As shown in FIG. 2, the system 200 may also include a performance measurement device 260. Such device may be used, for example, to measure the athlete's test performance. Although the performance measurement device 260 is shown as a global positioning system ("GPS"), any variety of devices may be used. For example, the device 260 may be a heart rate monitor, a stopwatch, or a power meter.

According to one embodiment, the performance measurement device 260 may include a processing unit capable of obtaining the training metric. Accordingly, such data may be directly uploaded to the computing device 210 via accessing a drive (USB, CD) of the computing device 210 or via direct communication link (infrared, cable, wireless Internet).

As mentioned above, the system 200 may be used to perform one or more steps of the method 100. For example, the user may enter the performance goal information or any other information using a keyboard, mouse, touch-screen, or any other device. Similarly, the user may also enter commands relating to the computation of performance models, etc.

Such data and command entry may be facilitated by via a graphical user interface (GUI). For example, FIGS. 3A-3D show dialogue boxes used for inputting various types of information.

Figure 3A:
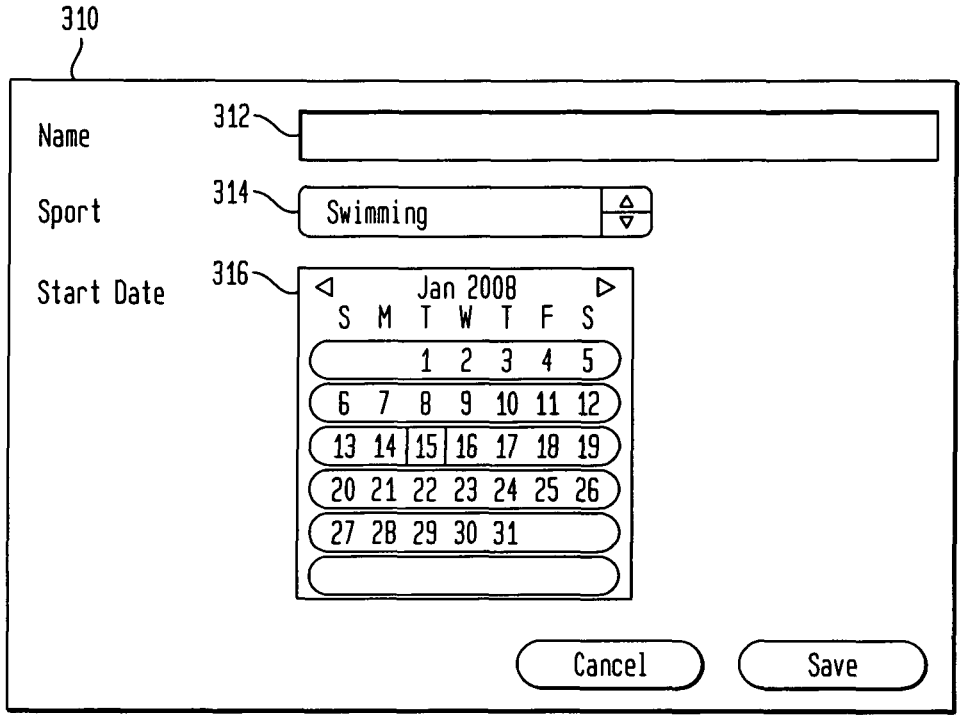

FIG. 3A provides dialogue box 310, which may be displayed to a user wishing to enter athlete information. Accordingly, as shown, data entry field are provided for the athlete's name, sport, and training start date. As illustrated, the data entry fields may be any type of input selection device, such as a drop-down menu, a free-text entry field, or the like. Further data input fields may also be provided in the dialogue box 310 or accompanying dialogue boxes.

Figure 3B:
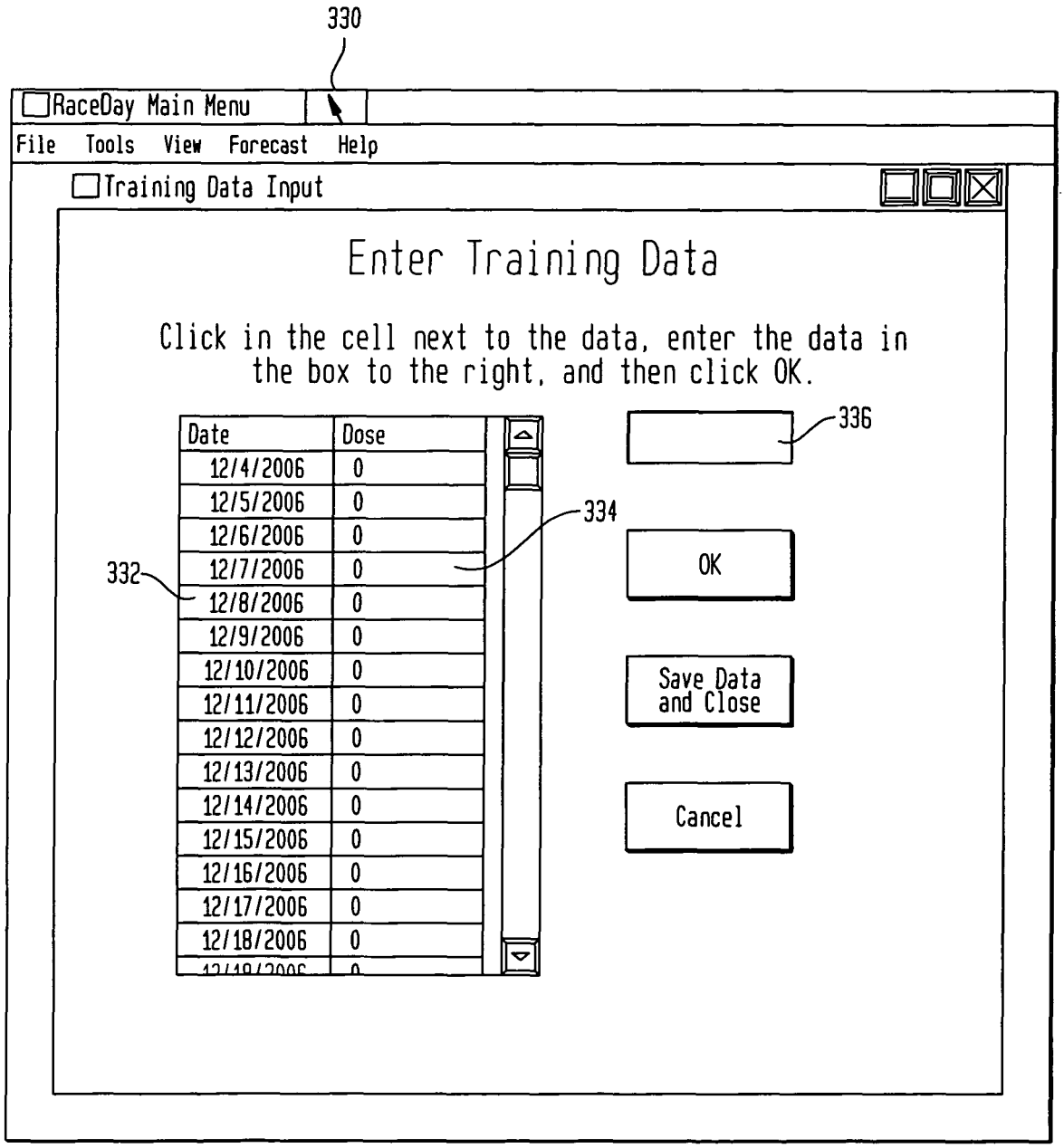

FIG. 3B provides a dialogue box 330 for inputting a user-generated training schedule. The dialogue box 330 provides a scroll-down list including a series of dates 332. These dates 332 may begin at a previously entered training start date or any other date desired by the user. Corresponding to the list of dates 332 is a list of training sessions, or "doses" 334. The user may enter information for these doses by clicking on a cell corresponding to a particular date and entering the training dose information in field 336. The training dose information may be any quantitative value, including power, heart rate, or most preferably training stress. Alternatively or additionally, the training dose information may include a description of each training session, such as distance to swim and time to complete swim. From this information the processor 240 may calculate the training dose.

FIG. 3C illustrates an example of a completed training schedule 350. As shown, the schedule indicates the athlete, the sport, the training start date, the training dates, the corresponding training doses, and values measured during test performances. It should be understood that further information may also be included in the training schedule, and that the information may be displayed in any format.

Figure 3D:
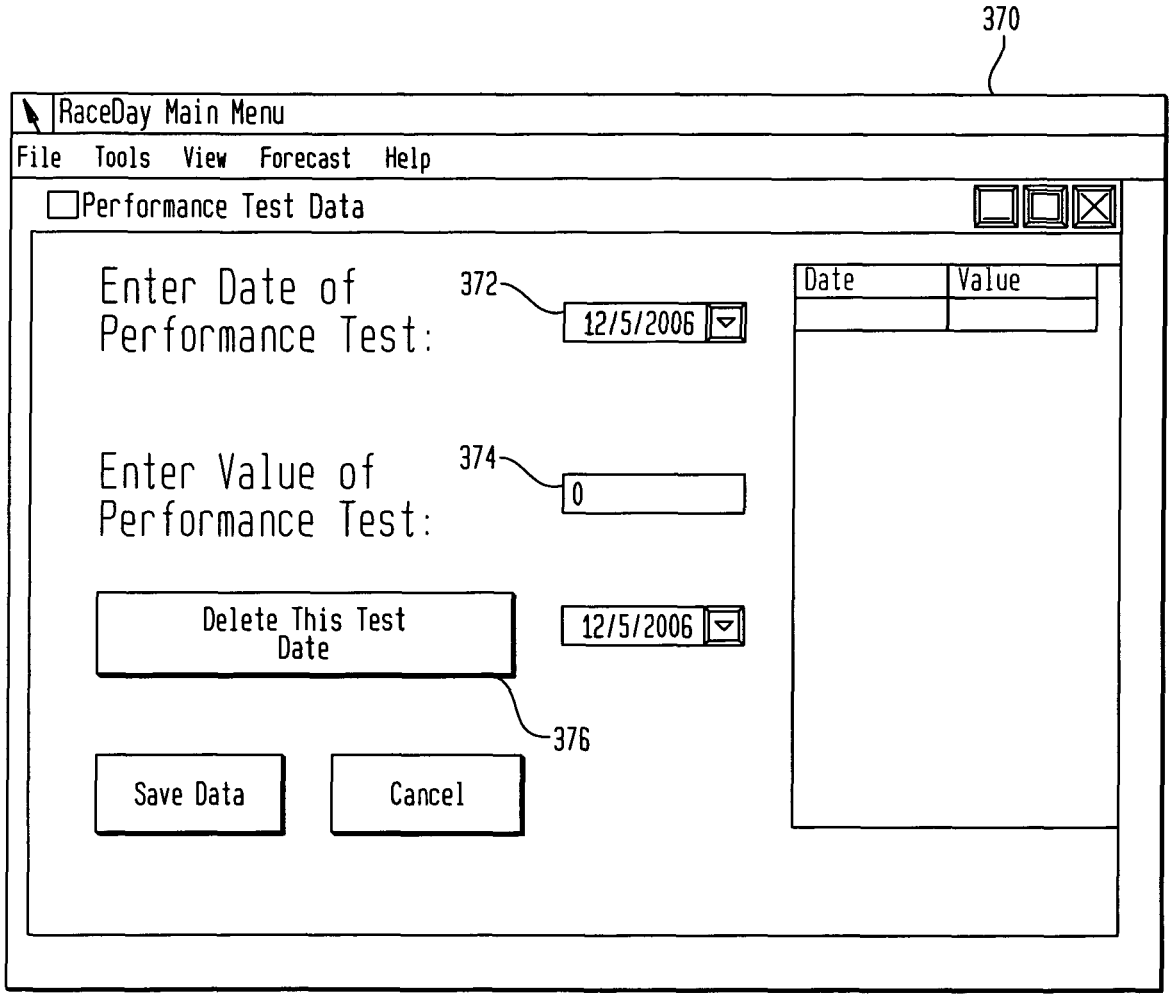

FIG. 3D provides a dialogue box 370 for inputting performance test data. Such data may include the date on which the test was performed (field 372) and the value measured during the performance (field 374). Similarly to the other dialogue boxes, the data input fields may be any of a variety of types and may enable input of more or less information. According to one aspect, the performance test data may also include an option for deleting a test date, such as input button 376. For example, if a test was not completed on a planned test date, the test date may be deleted.

The input provided by the user in steps 110 and 120 may be stored in memory 220. The processor 240 may then calculate the performance model. For exemplary program code relating to determining the performance model, please refer to Computer Program Listing Appendix B. This program code may be executed by the processor 240 to determine an athlete's predicted performance based on the athlete's training data, including at least one of past training data and future training data, and one or more constants. An exemplary program code for determining these constants is shown in Computer Program Listing Appendix A. Accordingly, the processor 240 may process the various input data according to the instructions provided in these Appendices. Graphical illustrations of the performance model may also be provided to the user via the display 270, as will be explained in further detail below with respect to FIG. 8.

The step if measuring test performance may be performed using measurement device 260. These measurements may then be input to the computing device 210.

Figure 4A:
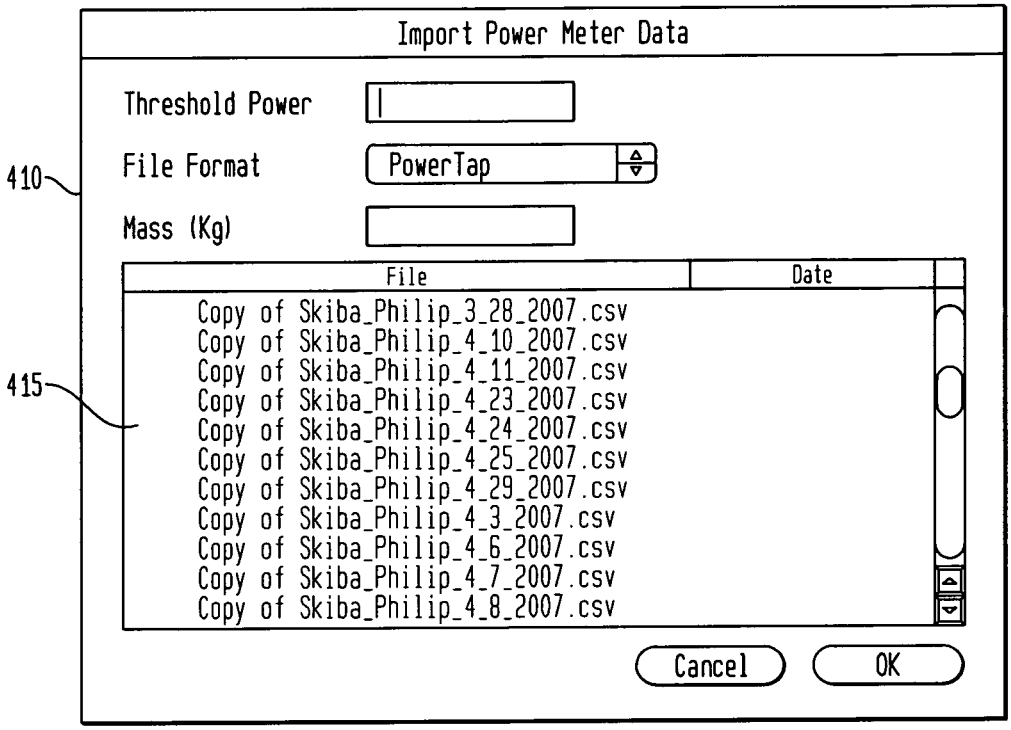
FIGS. 4A-4B are screenshots relating to training calculations according to an aspect of the present invention.

According to another embodiment, the performance measurements may be entered into the computing device as raw data (either through direct communication link or user intervention), and the training metric may be calculated by the processor 240. For example, FIG. 4A shows a dialogue box 410 for inputting power meter data. As shown, files stored in the power measurement device 260 may be uploaded to the computing system 210. Accordingly, a listing 415 of these uploaded files may appear in the dialogue box. Data entry fields for inputting a threshold power and athlete data (e.g., mass) may also be provided. Alternatively, the requisite information for calculating training stress may be derived from the uploaded files and/or previously entered information.

Figure 4B:
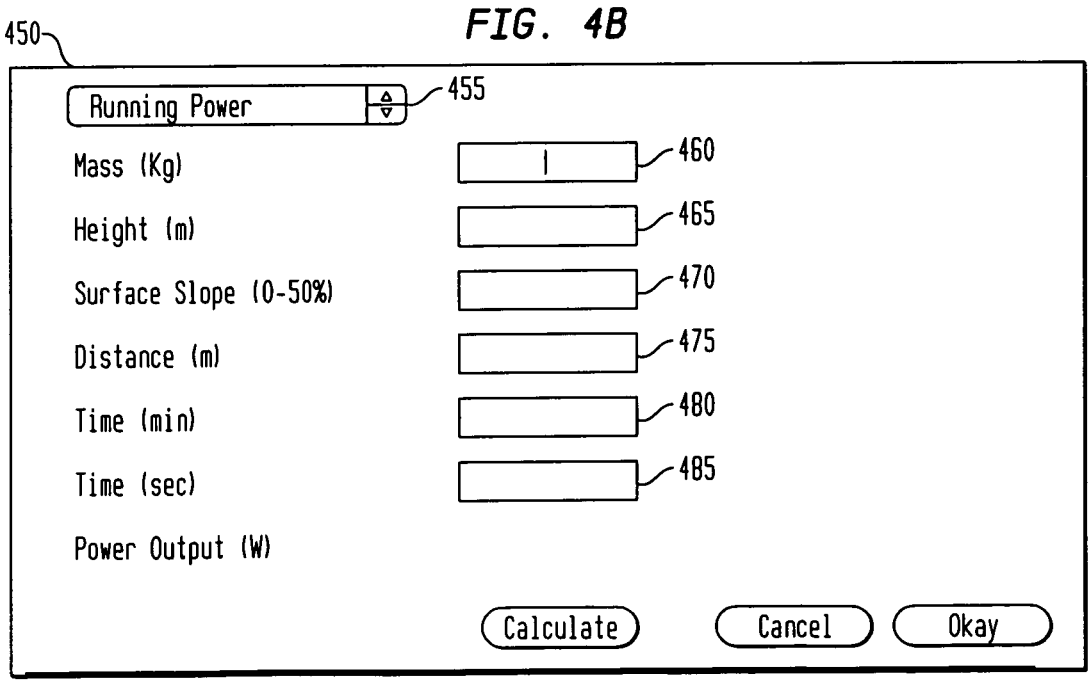

According to an even further embodiment, the training metric may be obtained by entering athlete and training information into predefined data fields, and calculating the metric using the computing device 210. For example, as shown in FIG. 4B, a dialogue box 450 includes numerous data entry fields 455-485 relating to measured performance information. These fields may include the sport (455), the athlete's weight (460) and height (465), and the dynamics of the workout (e.g., run over hills or on flat surface, distance run, time in which completed run). Using this data, the power output by the athlete and the training stress exerted may be calculated by the processor 240.

The measurement obtained by the measurement device 260 may be used in combination with other data or computations to derive a training metric. The training metric is a tool for calculating training stress. Examples of such training metrics include SwimScore™, BikeScore™, and Gravity Ordered Velocity Stress Score (GOVSS™).

SwimScore™, owned by PhysFarm Training Systems, LLC, is a metric which permits the calculation of a swimmer's training stress based on pace, rather than heart rate or other factors. It takes into account both the intensity and the duration of the effort.

Figure 5A:
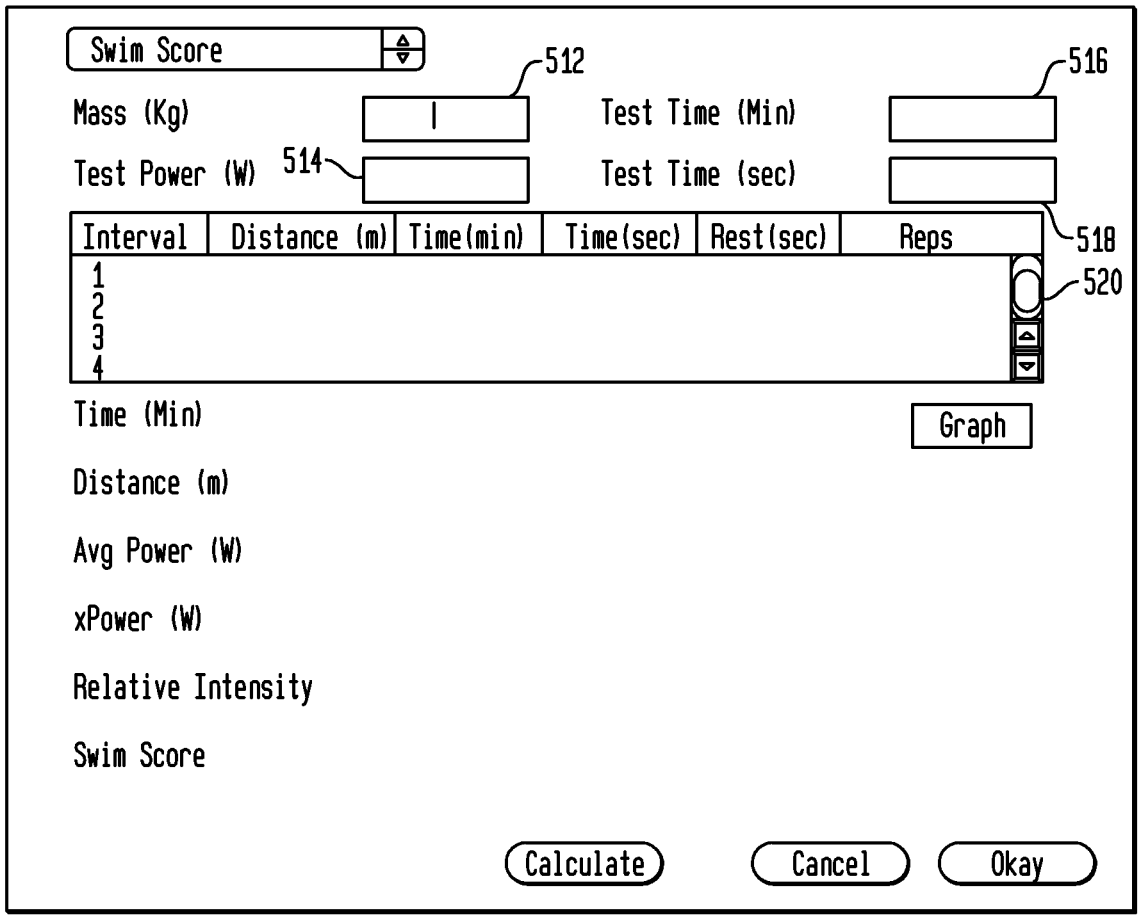
FIG. 5A (Prior Art)
FIGS. 5A-5B are screenshots relating to quantification of physical exertion according to an aspect of the present invention.
Figure 5B:
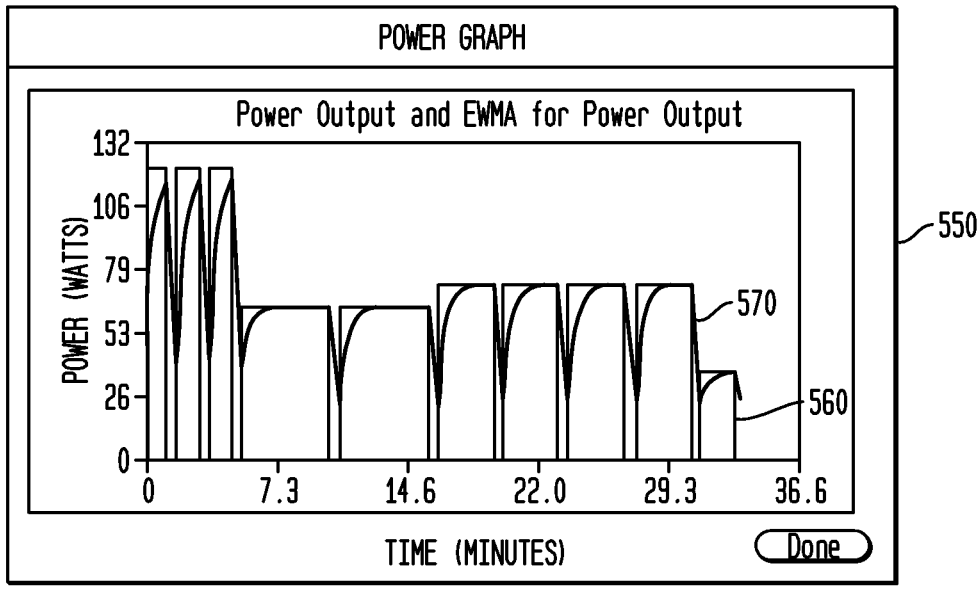
FIG. 5B (Prior Art)

An illustrated example of SwimScore is shown in FIGS. 5A-5B. According to this aspect, the metric implements a GUI as well as a timing device, such as a stopwatch. Data relating to the athlete and the athlete's performance measurements may be entered into dialogue box 510. For example, the athlete's weight may be entered into "Mass" field 512. The calculated test power, for example calculated using a method similar to that described with respect to FIG. 4B, may be entered into the "Test Power" field 514. Other information such as time taken to complete the threshold test may be entered into data fields 516 and 518. Workout description field 520 may receive information relating to the training session completed by the athlete. Such information may include the distance of each interval, the time the interval took in minutes and seconds, the interval of rest taken, and the number of repetitions. This information may be used to determine various performance indicia, such as the total distance trained, average power, xPower, relative intensity, and the SwimScore.

The average power is the mean power measured over the course of the workout. The xPower is the exponentially weighted and intensity-adjusted power. It indicates how the workout "felt" to the athlete by more heavily weighting the hard efforts than the easy efforts.

Relative intensity is the ratio of the xPower to the threshold power. A relative intensity of 1 is indicative of a swim that is more or less equivalent to your threshold test swim.

The SwimScore provides a quantitative value for the training stress incurred during the training. For reference, 100 SwimScore points may be equal to the test time at threshold power.

SwimScore may also provide a graphical view of the athlete's workout, as shown in FIG. 5B. Graph 550 plots data from the athlete's workout, with time (in minutes) as the x-axis and power (watts) as the y-axis. A first curve 560 is equal to the athlete's power output, and a second curve 570 is equal to the training stress for that workout. As indicated by the second curve 570, the training stress is low for the beginning of each interval. The athlete begins to "feel" the workout approximately 30 seconds into the interval. This "feeling" is physiologic strain (the reaction of the athlete's body) to the stress (the rate of work or power output).

BikeScore™, owned by PhysFarm Training System, LLC, is a metric which permits the calculation of an athlete's training stress based upon the athletic power output during a cycling workout and Functional Threshold Power (FTP). The FTP is power output in a 1 hour maximal test or 40k time trial.

BikeScore uses a math-intensive process that exponentially weights the average power generated to account for the fact that the body responds to many stimuli and has many processes that are better approximated using exponential functions.

Figure 6A:
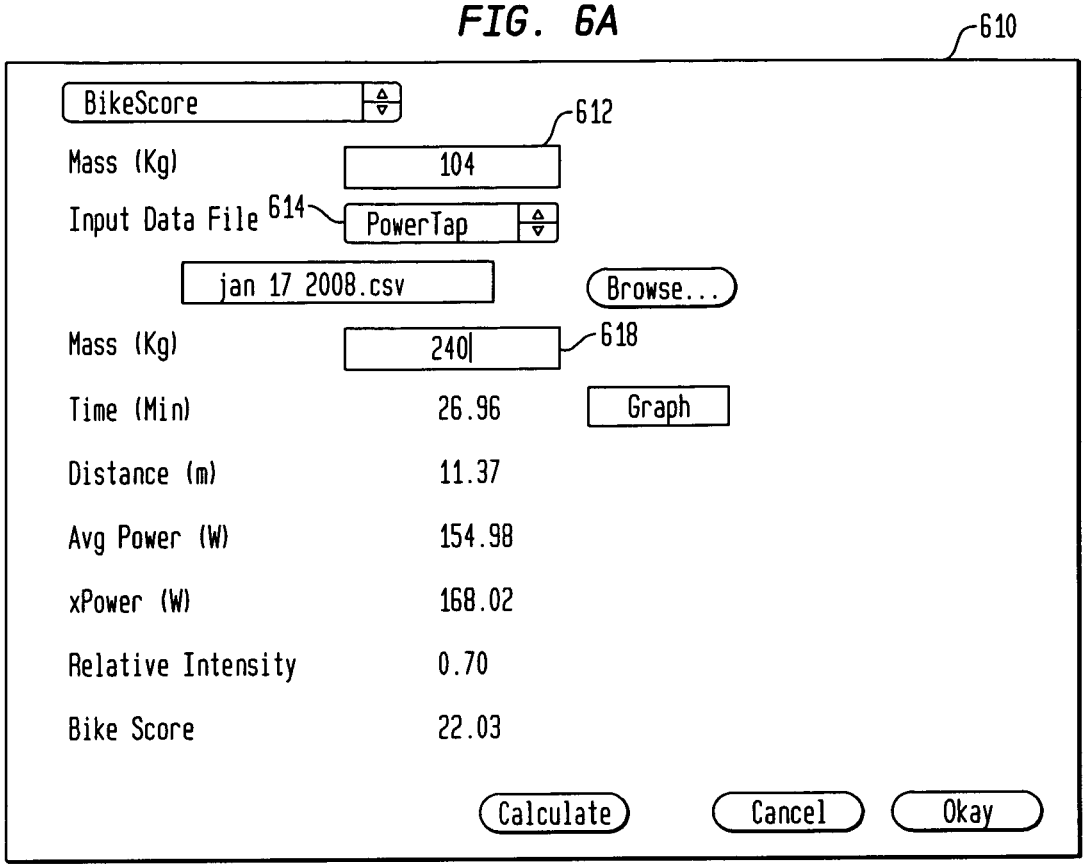
FIGS. 6A-6B are screenshots relating to quantification of physical exertion according to another aspect of the present invention.
Figure 6B:
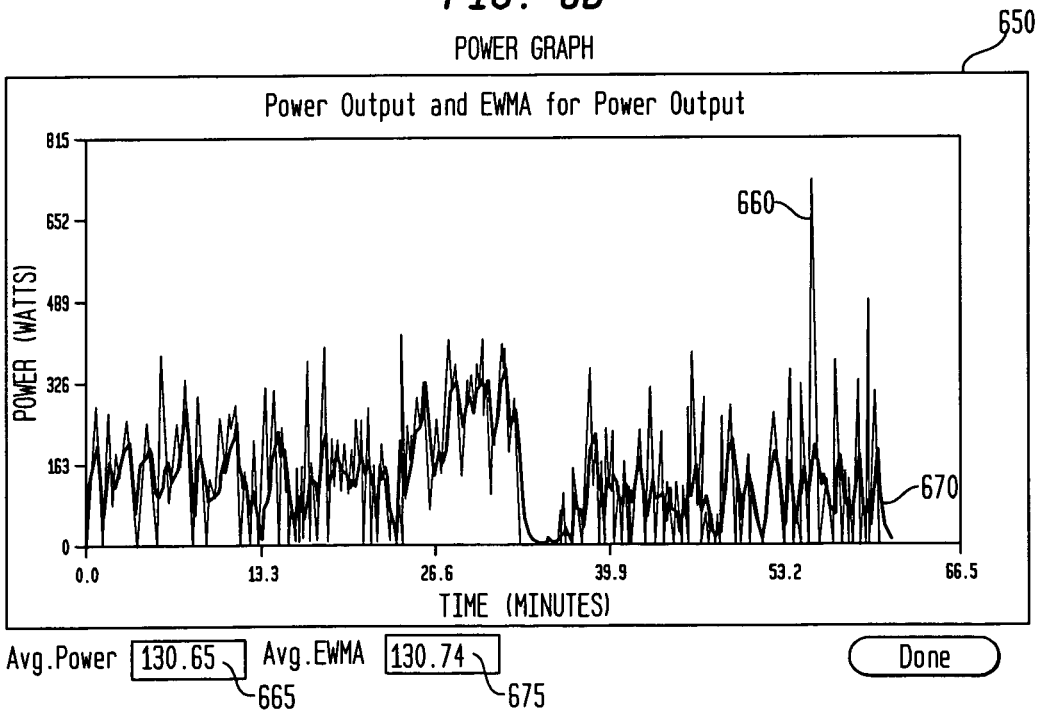

An illustrated example of BikeScore is shown in FIGS. 6A-6B. According to this aspect, BikeScore™ implements a GUI as well as a power meter. Data relating to the athlete and the athlete's performance measurements may be entered into dialogue box 610. For example, the athlete's weight may be entered into "Mass" field 612, while the athlete's measurements from the power meter are uploaded to "Input Data File" field 616. This data file could be obtained from any commercially available power meter/power measurement device such as the Saris PowerTap®, the SRM® power meter, and the Ergomo®. Threshold power, i.e., the best power held by the athlete for one hour, may also be measured using the power meter and input to the "Critical Power" field 618. This information may be used to determine various performance indicia, such as the time and distance trained, average power, xPower, relative intensity, and the BikeScore.

The average power is the mean power measured over the course of the workout. The xPower is the exponentially weighted and intensity-adjusted power. It indicates how the workout "felt" to the athlete. In a long, flat time trial where there was not much variation in power, the average power and xPower may come out almost identically, and thus either would be a good description of how hard the effort was. However, in a ride over many hills with long periods of very high power output and long periods of coasting downhill, there may be a significant difference between average power and xPower, because the average is depressed by the coasting periods. In this case, XPOWER is a better descriptor of how the workout "felt", because it more heavily weights the work periods than the rest period.

Relative intensity is the ratio of the xPower to the threshold power. A relative intensity of 1 is indicative of a ride that is more or less equivalent to your threshold test ride.

BikeScore provides a quantitative value for the training stress incurred during the training session. 100 points is equal to one hour at threshold power.

As shown in FIG. 6B, BikeScore™ may also provide a graphical display of the athlete's physical output during the training session. For example, graph 650 plots the power measured for the training session (first curve 660) and the training stress incurred by the athlete (second curve 670). This graph 650 also provides the average power 665 and the average training stress 675.

GOVSS™, owned by PhysFarm Training Systems, LLC, uses velocity and altitude change data as obtained from a GPS to derive a number indicative of both the duration and intensity of the exercise undertaken. It works in essentially the same way as the above metrics. However, it calculates the power output of the athlete using the athlete's physical characteristics, the quality of the running surface, and the slope of the running surface and speed of running, which are obtained from a GPS data file. This power data can then be manipulated, weighted for intensity, etc. This works well for running athletes. It has also been adapted for use in cross country skiing.

Figure 7:
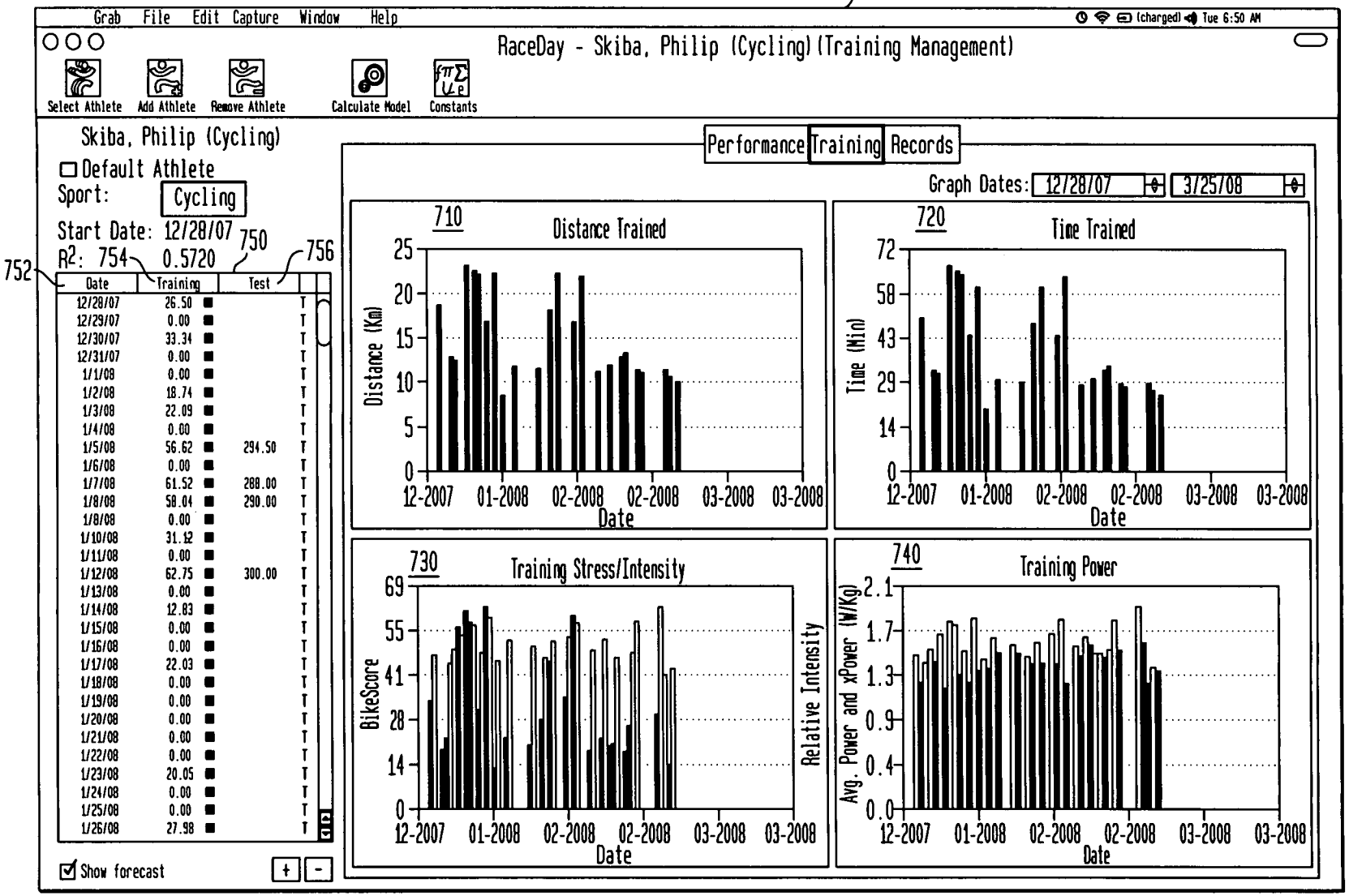
FIG. 7 is a screenshot relating to training according to an aspect of the present invention.

The display may provide visual output for various types of data. For example, as shown in FIG. 7, a training screen 700 is provided. This training screen 700 indicates trends in the athlete's training, wherein such trends may be expressed in any number of ways. As shown in FIG. 7, the user or athlete may view training records by distance (graph 710), time (graph 720), training stress (graph 730), and/or power (graph 740). Also displayed may be corresponding training schedule 750, including training dates 752, training doses 754, and tested performance measurements 756. It should be understood by those of skill in the art that the training screen 700 and the graphs 710-740 may portray training according to other variables as well. Further, although graphs 710-740 show trends in training already performed, predicted training trends may also be provided.

Figure 8:
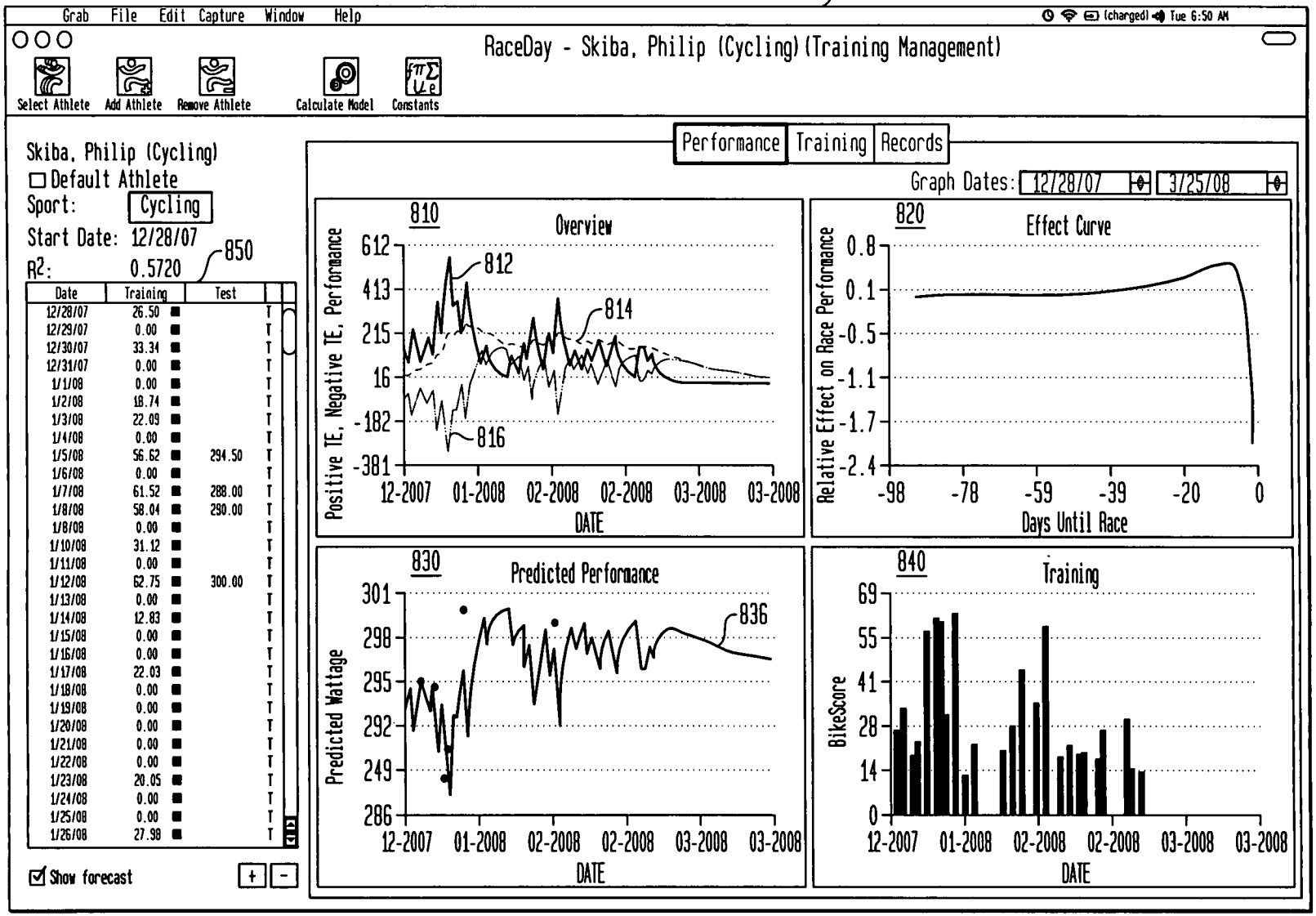
FIG. 8 is a screenshot relating to performance according to an aspect of the present invention.

As shown in FIG. 8, the display 270 may also provide output related to performance. For example, as shown in FIG. 8, performance screen 800 includes a training schedule 850 along with graphs portraying an overview of the performance calculations (graph 810), an effect of training in the days leading up to the competition date (graph 820), the athlete's predicted performance (graph 830), and the athlete's training (graph 840).

The overview graph 810 may portray positive training effects (line 812), negative training effects (line 814), and the athlete's predicted performance (line 816) over the course of the training schedule.

The effect curve graph 820 essentially asks the question, "If day zero is race day, will training X days before the race have a positive or negative effect on that race, and how positive and negative will that effect be?" For this athlete, we can see that benefits to race performance increase approximately 45 days before the race, peak about 19 days before the race, and then fall sharply. Thus, a taper in heavy training should begin sometime soon after this peak (e.g., between days 18-15).

The predicted performance graph 830 provides actual performance tests (black dots) plotted against the model predictions (curve 836). The measurements and predictions in the performance graph 830 are expressed in watts, although any variety of metrics may be used. The user may decipher whether the training schedule 850 is appropriate for the athlete based on whether the black dots align with the predicted performance curve 836. If these indicia are not relatively aligned, the training schedule 850 and/or performance prediction 836 may be revised.

Although the method 100 and system 200 have been described above with respect to human athletes, the method 100 and system 200 may also be used to calculate training data and performance predictions for other beings, such as for horses participating in equine sports.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A computer-implemented method of calculating athlete performance, comprising:

receiving at the processor information relating to records of the athlete's prior training sessions and prior performances;

calculating, using the processor, training stresses associated with each of the prior training sessions, wherein the training stress accounts for a duration and intensity of the training session;

calculating, using the processor, a positive training effect and a negative training effect associated with each of the prior training sessions according to the equations:

$$\text{Positive training effect}=\int_0^t (k_1 \cdot w(u) \cdot e^{-(t-u)/\tau 1})$$

$$\text{Negative training effect}=\int_0^t (k_2 \cdot w(u) \cdot e^{-(t-u)/\tau 2})$$

wherein $k_1$ and $k_2$ are constants, $\tau_1$ and $\tau_2$ are exponential decay constants, (t-u) is a time between training sessions, and w(u) is the training stress for that prior training session;

deriving a past performance value for each prior training session, wherein the past performance value equals the positive training effect minus the negative training effect;

calculating, using the processor, a predicted positive training effect and a predicted negative training effect for at least one time in the future;

deriving a predicted performance value for the at least one time in the future by subtracting the predicted negative training effect from the predicted positive training effect;

converting the predicted performance value into a percentile (PPP) by computing:

$$PPP=(((PP+((|MinPP|)+(SCALEFACTOR)/(|MinPP|+(SCALEFACTOR)+(MaxPP)))$$

wherein PP is the predicted performance value for the at least one time in the future, |MinPP| is the absolute value of a lowest predicted performance value, SCALEFACTOR is a constant, and MaxPP is a highest predicted performance value.

2. The method of computing physical performance according to claim 1, wherein a brute force method or other optimization routine is used to determine the constants.

3. A system for predicting athlete performance, comprising:

an interface for inputting information relating to records of the athlete's prior training sessions and prior performances;

a processor; and a memory storing the information relating to the records of the athlete's prior training sessions and prior performances and instructions executable by the processor for computing a predicted athlete performance based on the information relating to the prior training data, the instructions comprising:

calculating training stresses associated with each of the prior training sessions, wherein the training stress accounts for a duration and intensity of the training session, calculating a positive training effect and a negative training effect associated with each of the prior training sessions according to the equations:

$$\text{Positive training effect}=\int_0^t (k_1 \cdot w(u) \cdot e^{-(t-u)/\tau 1})$$

$$\text{Negative training effect}=\int_0^t (k_2 \cdot w(u) \cdot e^{-(t-u)/\tau 2})$$

wherein $k_1$ and $k_2$ are constants, $\tau_1$ and $\tau_2$ are exponential decay constants, (t-u) is a time between training sessions, and w(u) is the training stress for that prior training session;

deriving a past performance value for each prior training session, wherein the past performance value equals the positive training effect minus the negative training effect;

calculating, using the processor, a predicted positive training effect and a predicted negative training effect for at least one time in the future;

deriving a predicted performance value for the at least one time in the future by subtracting the predicted negative training effect from the predicted positive training effect;

converting the predicted performance value into a percentile (PPP) by computing:

$$PPP=(((PP+((|MinPP|)+(SCALEFACTOR)/(|MinPP|+(SCALEFACTOR)+(MaxPP)))$$

wherein PP is the predicted performance value for the at least one time in the future, |MinPP| is the absolute value of a lowest predicted performance value, SCALEFACTOR is a constant, and MaxPP is a highest predicted performance value;

receiving at the processor information related to at least one test athlete performance.

4. The system for predicting athlete performance according to claim 3, further comprising a display for outputting the predicted performance percentile.

5. The system for predicting athlete performance according to claim 3, wherein the interface for inputting information comprises a power meter electrically coupled to the processor.

6. The method of claim 1, further comprising:

receiving at the processor information related to at least one test athlete performance;

converting the information related to the at least one test athlete performance into a percentile (TPP) using the equation:

$$TPP = TP/MaxTP$$

wherein TP is the test performance and MaxTP is a highest prior performance; and modifying PPP by:

adjusting $k_1$, $k_2$, $\tau_1$, and $\tau_2$ until a sum of squares of a difference between PPP and TPP is minimized; and iteratively varying SCALEFACTOR until a lowest possible sum of squares is achieved.

* * * * *